US005507551A

United States Patent [19]

Barry

[11] Patent Number: 5,507,551

[45] **Date of Patent: *Apr. 16, 1996**

[54] STUFFED FIGURE CHAIR

[75] Inventor: Timothy P. Barry, Fishers, Ind.

[73] Assignee: TSB, Inc., Fishers, Ind.

[ * ] Notice: The term of this patent shall not extend beyond the expiration date of Pat. No. 5,354,118.

[21] Appl. No.: 320,510

[22] Filed: Oct. 7, 1994

Related U.S. Application Data

[63] Continuation of Ser. No. 95,871, Jul. 21, 1993, Pat. No. 5,354,118.

[51] Int. Cl.[6] ..... A47D 1/00

[52] U.S. Cl. ..... 297/181; 297/219.1; 297/464; 297/DIG. 6

[58] Field of Search ..... 297/181, 219.1, 297/464, 485, DIG. 6, 219.12; 5/633, 640, 653, 657, 907

[56] References Cited

U.S. PATENT DOCUMENTS

| | | | |
|---|---|---|---|
| D. 279,727 | 7/1985 | Mitchell | D2/343 |
| 289,115 | 11/1883 | McDonald . | |
| D. 294,099 | 2/1988 | Bromberg et al. | D6/611 |
| 1,769,722 | 7/1930 | Sutton . | |
| 2,119,023 | 5/1938 | Pickard . | |
| 2,663,359 | 12/1953 | Wood . | |
| 2,961,668 | 11/1960 | Hayes | 5/337 |
| 3,008,763 | 11/1981 | Lebow | 297/181 |
| 3,635,528 | 1/1972 | Strom | 297/456 |
| 3,737,196 | 6/1973 | Boder | 297/181 |
| 3,840,916 | 10/1974 | Jennings | 5/337 |
| 3,995,335 | 12/1976 | Neely | 5/327 |
| 4,197,604 | 4/1980 | Nakamura | 5/437 |
| 4,245,426 | 1/1981 | Sullivan | 46/103 |
| 4,410,214 | 10/1983 | Gerschwender | 297/118 |
| 4,441,221 | 4/1984 | Enste et al. | 5/431 |
| 4,538,310 | 9/1985 | Scott | 5/437 |
| 4,586,747 | 5/1986 | Taylor | 297/250 |
| 4,695,092 | 9/1987 | Hittle | 297/250 |
| 4,734,948 | 4/1988 | Danova | 5/502 |
| 4,754,512 | 7/1988 | Chao-Yang | 5/482 |
| 4,759,588 | 7/1988 | Husnik | 297/468 |
| 4,871,210 | 10/1989 | Alexander et al. | 297/435 |
| 4,909,573 | 3/1990 | Barry et al. | 297/456 |
| 5,076,264 | 12/1991 | Lonardo et al. | 297/464 X |
| 5,112,104 | 5/1992 | De Giacomi | 297/229 |
| 5,123,699 | 6/1992 | Warburton | 297/485 X |
| 5,137,335 | 8/1992 | Marten | 297/485 |

FOREIGN PATENT DOCUMENTS 0251139 6/1987 European Pat. Off. .

*Primary Examiner*—Peter R. Brown

*Attorney, Agent, or Firm*—Ice Miller Donadio & Ryan; Paul B. Overhauser; Doreen J. Gridley

[57] ABSTRACT

A stuffed figure chair including a cushioned figure, a removable seat, and a mechanism for removably fastening the removable seat to the cushioned figure. The cushioned figure includes a torso connected to a pair of lower limbs. Separate strap receiving members or loops are part of the fastening mechanism and are attached to the stuffed figure at each of the lower limbs, and preferably also the torso. The removable seat is structured to be received between the lower limbs of the cushioned figure. Strap elements attached to the removable seat are engageable with the strap receiving members on the figure to secure the removable seat to the cushioned figure. Because the connections between the torso and limbs are sufficiently inflexible so as to provide a resistance to pivotal motion of the torso relative to the limbs, an occupant of the seat fastened to the cushioned figure can lean back against and be supported by the figure torso. By unfastening the strap elements from the strap receiving members, the seat can be removed from the cushioned figure to allow the figure to be used as a toy.

3 Claims, 2 Drawing Sheets

STUFFED FIGURE CHAIR

This is a continuation application of application Ser. No. 08/095,871, filed Jul. 21, 1993, now U.S. Pat. No. 5,354,118.

FIELD OF THE INVENTION

This invention relates to a support device, and, in particular, to a support device which utilizes a stuffed figure in combination with a removable seat to provide a chair which can be converted to a stuffed toy.

BACKGROUND OF THE INVENTION

Stuffed figures, especially stuffed animals such as teddy bears, are widely recognized as objects of affection and amusement for many children. In order to capitalize on this affection, products have been made which incorporate stuffed figures or animals into their designs. The resulting products are often highly desirable to children and adults alike, as children enjoy the product appearance and adults appreciate the corresponding greater likelihood of use by the children. In the past, support devices such as chairs have so incorporated stuffed figures into their design. For instance, U.S. Pat. No. 4,909,573, which is herein incorporated by reference, discloses a type of stuffed figure chair with a seat disposed between the figure's legs. In order to provide proper support to allow a child to lean back against the figure, a rigid frame is disposed within the body of the stuffed figure. While functional, this design suffers from several shortcomings.

Specifically, the cost of manufacture is quite high as a result of the expense of both the manufacturer of the frame and its placement inside the stuffed figure. In addition, because the frame often shifts within the figure during use, the frame could move out of position and thereby diminish the support characteristics of the chair. Furthermore, the stuffed figure was less than an ideal toy because a child, upon pouncing on or playing with the stuffed figure, could be jarred by the frame and suffer injury.

OBJECTS OF THE INVENTION

Accordingly, one object of the present invention is to provide a stuffed figure chair that utilizes a stuffed figure and provides sufficient support without necessarily including a rigid frame within the figure.

Another object of the present invention is to provide a stuffed figure chair with a removable seat, thereby allowing the stuffed figure to be utilized as an ordinary play toy rather than merely as a piece of furniture.

A still further object of the present invention is to provide a stuffed figure with a seat which is removably connected to the stuffed figure in a simple manner, thereby allowing the seat to be easily removed.

A still further object of the present invention is to provide a stuffed figure with a removable seat, wherein the removable seat and its connection to the figure are achieved with limited materials and manufacturing costs.

SUMMARY OF THE INVENTION

In one form thereof, the chair of the present invention is for use on a support surface such as a floor and comprises a cushioned figure, a removable seat, and means for removably fastening the removable seat to the cushioned figure. The cushioned figure includes a torso and first and second limbs. The limbs are connected to the torso and extend forward from and generally perpendicular to the torso. The limbs and torso each have an underside surface, and at least a portion of the underside surfaces of the first and second limbs contact the support surface when the cushioned figure is without a seat and is positioned upright. The removable seat, which has a bottom surface, is structured to be received between the first and second limbs. The means for removably fastening the removable seat to the cushioned figure includes a plurality of first fastening components and at least one cooperating second fastening component. At least one first fastening component is attached to the underside surface of the first limb, and at least one first fastening component is attached to the underside surface of the second limb. The cooperating second fastening component is attached to the removable seat. The first fastening components on the limbs are engagable with the cooperating second fastening component to secure the removable seat to the cushioned figure limbs such that the bottom surface of the seat contacts the support surface when the secured removable seat is occupied.

In another form thereof, the chair of the present invention includes a cushioned figure, a removable seat, and means for removably fastening the removable seat to the cushioned figure. The cushioned figure includes a torso and first and second limbs. The limbs are connected to the s torso and extend forward from and generally perpendicular to the torso. The connections between the torso and limbs are sufficiently inflexible so as to provide a resistance to pivotal motion of the torso relative to the limbs. The removable seat is structured to be received between the first and second limbs. The means for removably fastening the removable seat to the cushioned figure include a plurality of strap receiving members and at least one cooperating strap element. At least one strap receiving member is attached to the first limb, and at least one strap receiving member is attached to the second limb. The at least one cooperating strap element is attached to the removable seat, and the strap receiving members on the limbs are engagable with the at least one cooperating strap element to secure the removable seat to the cushioned figure limbs. The seat fastening means may also include at least one strap receiving member attached to the torso and an additional at least one cooperating strap element attached to the removable seat. The at least one strap receiving member attached to the torso is engagable with the additional at least one cooperating strap element to further secure the removable seat to the cushioned figure.

In another form thereof, the stuffed figure chair of the present invention is for use with a support surface and includes a cushioned figure, a removable seat, and means for removably fastening the removable seat to the cushioned figure. The cushioned figure includes a torso and first and second limbs. The limbs are connected to the torso and extend forward from and generally perpendicular to the torso. The limbs contact the support surface when the torso is positioned upright and when a seat is not secured to the figure. The removable seat has a bottom surface and is structured to be received between the first and second limbs. The means for removably fastening the removable seat to the cushioned figure includes a plurality of strap receiving members and a plurality of cooperating strap elements. At least one strap receiving member is attached to the first limb, and at least one strap receiving member is attached to the second limb. The plurality of cooperating strap elements are attached to the removable seat. The strap receiving members are engagable with the cooperating strap elements to secure the removable seat to the cushioned figure limbs. The seat fastening means causes the limbs to remain substantially parallel to the support surface when the seat bottom rests on the support surface. The torso provides a back support force on an occupant positioned on the removable seat and reclining against the torso, and the strength of the back support force is provided entirely by a resistance to pivotal motion of the torso relative to the limbs. The resistance results from an inflexibility of the connection between the torso and limbs.

DETAILED DESCRIPTION

Figure 1:
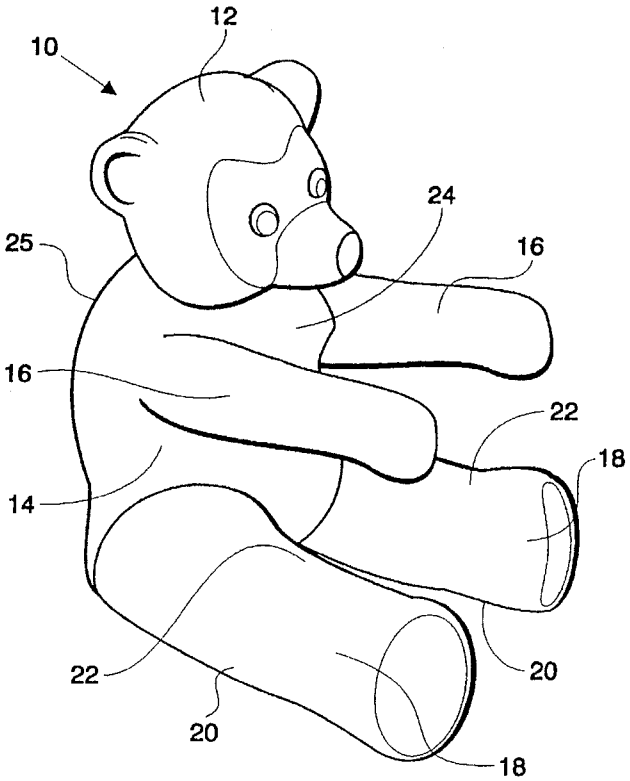
FIG. 1 shows a perspective view of a stuffed figure of the present invention without the removable seat fastened thereto.

Referring to FIG. 1, there is shown a perspective view of a stuffed figure which is utilized with a removable seat to form the stuffed figure chair of the present invention. In this embodiment, the stuffed or cushioned figure is shaped in the form of a bear, generally designated 10, and is seated in an upright position. It will become apparent that a variety of figure shapes, including but certainly not limited to various animals or human shapes, can be utilized in the invention, Bear 10 essentially comprises head 12, torso 14, and two pairs of limbs 16, 18. Torso 14 as explained herein includes chest 24, back 25, and an underside surface or bottom 27. Limbs 16 correspond to the front legs or arms of bear 10, and limbs 18 correspond to the hind legs of bear 10. While limbs 16, 18 normally are expected to be arms or legs of the stuffed figure, other limb constructions, for example tentacles of an octopus, are not intended to be precluded.

Bear 10 is essentially a standard, large stuffed teddy bear which can be utilized as a play toy, although preferably not when not outfitted with removable seat 40 which is described more fully hereinafter. Constructed in a posture properly characterized as a seated position, bear 10 has legs 18 and arms 16 which are generally perpendicular to torso 14. Legs 18 and arms 16 extend forward from torso 14 and are slightly splayed outward. Legs 18 have been made slightly larger in size relative to torso 14 than legs for some stuffed bears. This increase in size provides bear 10 with both a lower center of gravity and more substantial legs, which in turn provides a cushioned figure that is well suited to deliver occupant back support as described hereinafter. The interior of bear 10 is preferably filled entirely with shredded foam to provide the figure with its cushioned quality. A preferred filling provides torso 14 and legs 18, as well as arms 16 and head 12, with sufficient firmness to retain their basic shapes under normal use conditions without unduly sacrificing the softness associated with a teddy bear stuffed figure.

Bear 10 differs from those types of stuffed animals with extremities connected to the animal body in a manner so as to be freely flexible relative to the animal body, thereby allowing the arms or legs to flop around under the force of gravity when the stuffed animal is carried or moved. Instead, the connection between torso 14 and limbs 18, as well as the connection between torso 14 and limbs 16, is substantially more inflexible, such that legs 18 and arms 16 are predisposed to remain in the same position relative to torso 14 despite the effects of gravity. In other words, bear 10 of FIG. 1 will not experience a marked change in its orientation when lifted from the floor or support surface on which it is seated upright. Besides maintaining the upright orientation of bear 10 when it is used as a toy, the connections between torso 14 and limbs 18 are also sufficiently inflexible so as to provide a resistance to pivotal motion of torso 14 relative to limbs 18, which allows torso 14 of bear 10 to serve as a chair back support as described more fully hereinafter.

Along the majority of their respective lengths, arms 16 and legs 18 are generally circular in cross-section. The underside surfaces 20 and topside surfaces 22 of limbs 18 respectively comprise the lower half and upper half of the perimeter of limb 18, wherein upper and lower directions are defined in relation to bear 10 when seated upright.

Figure 2:
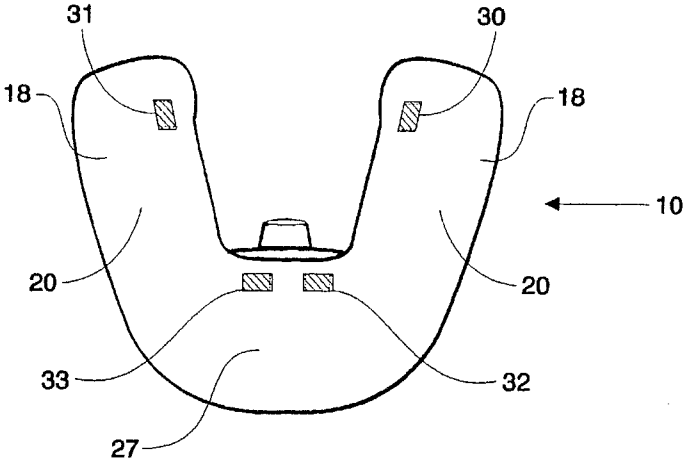
FIG. 2 shows a bottom view of the stuffed figure of FIG. 1.

Referring now to FIG. 2, there is shown a bottom view of stuffed bear 10. When torso 14 and thereby bear 10 is positioned upright, and at least when seat 40 is not secured to bear 10, limbs 18 and bear bottom 27 contact the support surface and thereby carry the weight of bear 10. More accurately, because the entire lower half of limbs 18 is not pressed into contact with the floor when subjected to a loading force, only part of, or at least a portion of, underside surfaces 20 of limbs 18 carries the weight. The first fastening components of the stuffed figure chair which allow for the removable fastening of seat 40 to bear 10 are evident in this view.

Positioned on the forward half of each leg 18 and preferably proximate the forward ends of each leg 18 are strap receiving members 30, 31. These members are attached to underside surfaces 20 of limbs 18. Additional strap receiving members 32, 33 are positioned on torso 14. These members are attached to bear underside 27 near the forward side or chest 24 of bear 10. Each strap receiving member 30–33 is preferably a loop fashioned by stitching two opposing short ends of a rectangular shaped piece is of durable fabric to bear 10. While loops made from separate fabric pieces permanently sewn to cushioned FIG. 10 are illustrated herein, other constructions are possible. For example, strap receiving members 30–33 could comprise appropriately sized and spaced slots within the fabric of the underside surfaces of bear 10. In this embodiment, loops 30–33 are positioned on those portions of underside surfaces 20 of limbs 18 which come into contact with the floor or support surface when stuffed FIG. 10 is seated upright. While loops 30–31 could be disposed further around legs 18 at a location closer to topsides 22, the disclosed construction is preferred because these strap receiving members are effectively hidden from view. As a result, when seat 40 has been removed, nothing about the appearance of bear 10 suggests it is anything other than a normal stuffed teddy bear toy.

Figure 3:
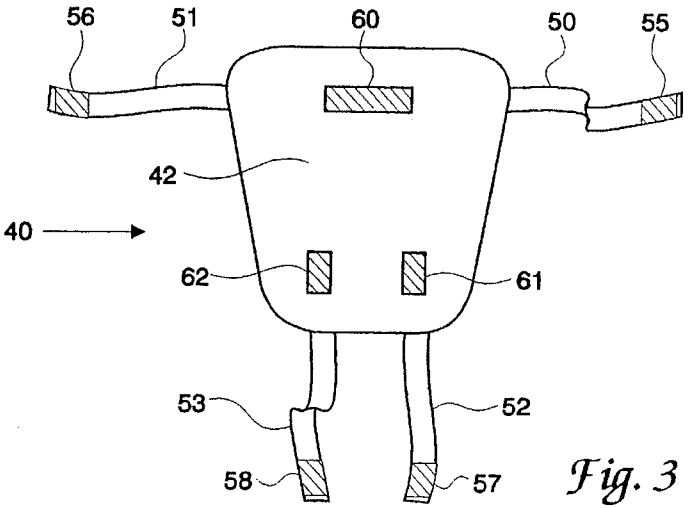
FIG. 3 shows a bottom view of the removable chair seat of the present invention separate from the stuffed figure.

FIG. 3 shows a bottom view of a removable chair seat, generally designated 40, separate from the stuffed FIG. 10 to which it can be removably fastened to form the stuffed figure chair of the present invention. Removable seat 40, which is structured to be received between limbs 18, is made out of a foam rubber material and covered with vinyl. The foam rubber construction provides seat 40 with a comfortable cushion for an occupant thereof. The foam rubber construction of seat 40 also supplies enough rigidity to inhibit bending of the seat without introducing a solid support piece therein which would be more likely to injure a child were stuffed FIG. 10 used as a toy prior to seat removal. Vinyl is a preferred seat covering due to its easy cleanup properties, as on occasion children who enjoy stuffed figure chairs of the present invention have accidents requiring cleanup.

Attached to seat 40 are second fastening components which cooperate or are engageable with the first fastening components disposed on stuffed FIG. 10 to allow for the fastening and unfastening of removable seat 40 to cushioned FIG. 10. In this embodiment, the second fastening components comprise four flexible strap elements 50, 51, 52, 53. Each of straps 50–53 corresponds to one of loops 30–33 and cooperates therewith during the attachment of seat 40 to bear 10. As a result, straps 50–53 are all disposed at locations around seat 40 which, when seat 40 is properly oriented between limbs 18, are aligned with and proximate to loops 30–33. In this embodiment, the straps are made of the same fabric from which the loops are made. One end of each fabric strap 50–53 is directly attached by stitching to seat 40 along the periphery of bottom surface 42, or more precisely along the seams between bottom surface 42 and the side surfaces of seat 40. Proximate the other or opposing end of each fabric strap 50–53 is disposed a VELCRO® hooks fastening member 55–58. Three VELCRO® loops fastening members 60–62, complementary to the hooks fastening members, are stitched to the bottom surface 42 of seat 40 so as to be flush therewith. Loop fastening member 60 is large enough to be engageable with both hooks fastening member 55 of fabric strap 50 as well as hooks fastening member 56 of fabric strap 51. Loop fastening members 61 and 62 are sized and shaped to respectively be engageable with hooks fastening member 57 of fabric strap 52 and hooks fastening member 58 of fabric strap 53. A fabric segment, or in other words a slight gap between the distal edges of the straps and the fastening members 55–58, serves as a grip for a person to pull on the fabric straps so as to detach the hooks and loops connection.

Figure 4:
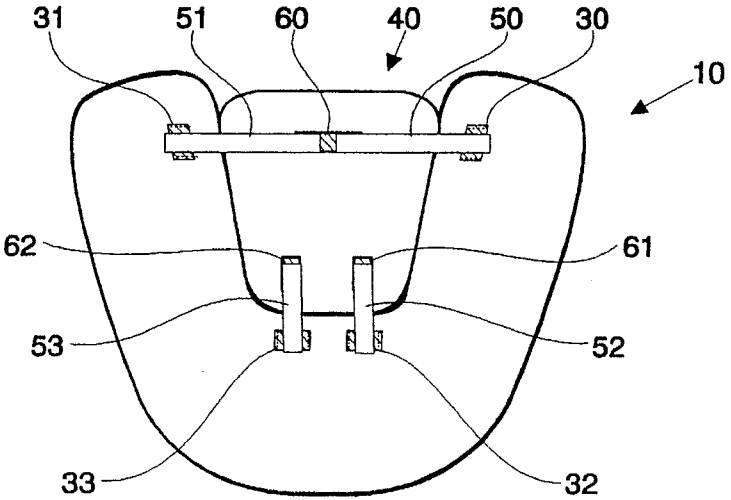
FIG. 4 shows the stuffed figure of FIG. 2 after the removable chair seat of FIG. 3 has been fastened to the stuffed figure.

When chair seat 40 is to be fastened to bear 10, thereby converting bear 10 from a toy to a chair, bear 10 is preferably tipped onto its back 25. A person should then position herself behind underside 27 of bear 10, which means she would then be faced with a view of stuffed figure 10 similar to that view shown in FIG. 2. Removable seat 40, with its bottom surface 42 facing toward the person, should then be oriented between the upright and slightly splayed legs 18. After the above steps are completed, each fabric strap 50–53 is first threaded through its corresponding loop 30–33. The portion of the fabric straps 50–53 inserted through the loops is then doubled back. After each fabric strap 50–53 is pulled taut, thereby forcing seat 40 into tight contact with limbs 18 and torso 14, the fabric straps are in position to be secured. By pressing the various hooks fastening members 55–58 down into contact with loops fastening members 60–62, fabric straps 50–53 are held fast. Fabric straps 50–53, along with their associated loops and hooks fastening members, are designed and constructed precise enough to allow for a tight strapping and securing of seat 40 to bear 10. After this fastening, the configuration of seat 40, bear 10, and the fastening means therebetween is as shown in FIG. 4. In order to convert the stuffed figure chair back to a toy, a person merely needs to reverse the above steps and remove seat 40 from bear 10.

Figure 5:
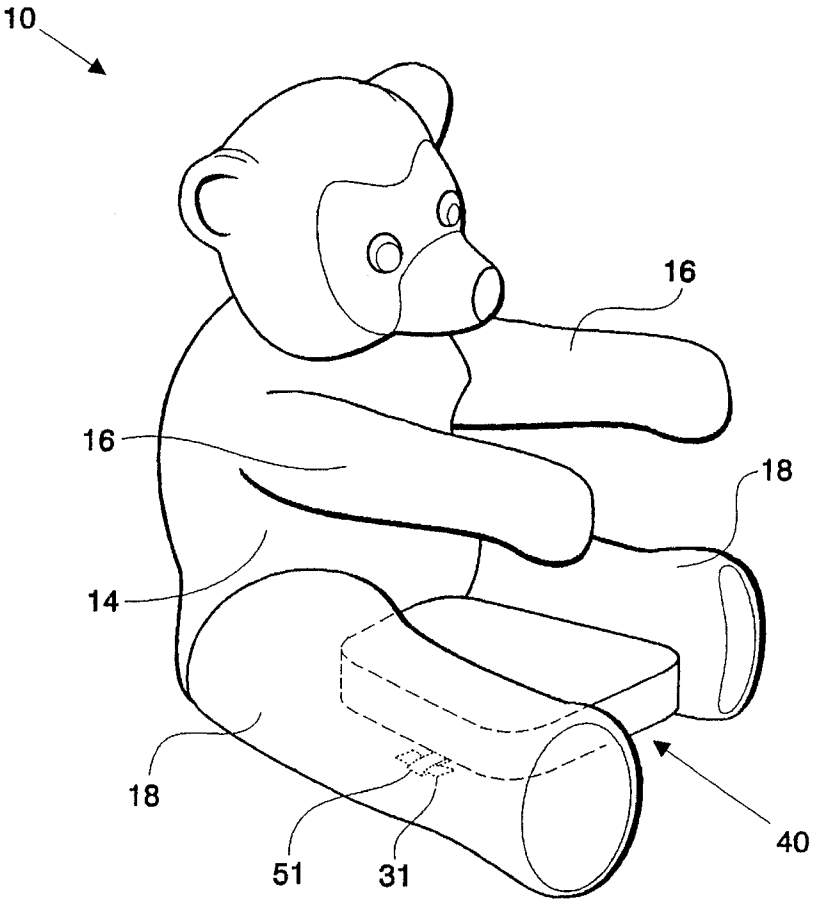
FIG. 5 shows a perspective view of the stuffed figure chair of the present invention with the removable chair seat fastened to the stuffed figure.

Bear 10, with seat 40 disposed between its lower limbs 18, can then be returned to an upright orientation as shown in FIG. 5. The stuffed figure chair of the present invention is now suitable for use as a chair. Ordinarily, a person would seat herself on the cushioned chair seat 40 with her legs outstretched, her torso between arms 16, and her back against chest 24 of torso 14. The nose on head 12 of bear 10 does not necessarily interfere with the seating of a person on the chair. For instance, a great many children, for whom this chair is ideally suited, are too short or small to encounter the nose when reclining. For other children, it is possible for them to position their respective heads away from the nose at a more comfortable location near the shoulder of the bear, and thereafter rest their respective heads on the upper part of arm 16. Moreover, it is possible to make different sized stuffed FIGS. 10 and corresponding seats 40 for different sized users, including adults.

When chair seat 40 is so occupied, bottom surface 42 of seat 40 contacts the support surface. And, when a person is sitting straight up or in other words not reclining back, at least a portion of the undersides of limbs 18 will also be in contact with the support surface. Straps 50, 51 and loops 30, 31, as well as straps 52, 53 and loops 32, 33, respectively maintain limbs 18 and torso 14 secure against seat 40. As a result, when seat bottom surface 42 rests on or is pressed against the floor or support surface, limbs 18 are also caused to remain substantially parallel to the support surface.

The back support characteristics of the stuffed figure chair, and the related ability of an occupant to recline, are provided by the construction of bear 10 and seat 40 and the fastening means therebetween. It will be appreciated that when a person occupies seat 40, the weight of the occupant holds down seat 40 and thereby, due to the engagement of straps 50, 51 with loops 30, 31, also effectively holds down legs 18. When the person occupying chair seat 40 reclines or rests her weight back against torso 14, torso 14 is necessarily forced backward. Because limbs 18 are being held in place, the way torso 14 moves backward is by pivoting relative to legs 18. This pivoting acts against the inflexibility of the pivotal connection of torso 14 to limbs 18. As this inflexibility or resistance must be overcome in order to move torso 14 backward, torso 14 provides a weight supporting force. In other words, this weight supporting force or back support force on an occupant positioned on removable seat 40 is a function of a resistance to pivotal motion of torso 14 relative to limbs 18, wherein the resistance is a result of, or provided by, the inflexibility of the connections between torso 14 and limbs 18. The extent of the resistance to pivotal motion of these connections, or in other words the inflexibility of these connections, is effected by, for instance, the material covering bear 10, the type and amount of the stuffing, and the stitching. The connections employed help determine the suitability of different stuffed figure chairs for different individuals. For instance, for a small child, the inflexibility of the connections need not be very large as torso 14 need only supply a resistance equal to the small amount of weight applied thereto. However, an adult too large for the same chair who uses and leans completely backward on the chair will probably not be supported by the chair and will likely recline much further, provided the chair does not break or rip first.

It will be appreciated that as a person leans back, and as torso 14 is forced farther back, the tendency will be for legs 18 to slightly lift off the support surface. Furthermore, due to the foam rubber seat construction, those side regions of removable seat 40 which do not have weight applied thereto will tend to partially bow up relative to seat 40. However, as long as the occupant's weight is applied to seat 40, legs 18 will remain close to the floor and bear 10 will not tip over backwards. It will also be appreciated that because the center of gravity of bear 10 is lower than in other stuffed figures, less of the resistance to pivotal motion of torso 14 relative to limbs 18 is required to support the bear's own weight, and that more substantial legs 18 decrease the likelihood of legs 18 buckling during occupant reclining.

As is evident from the foregoing disclosure, the present invention provides a stuffed figure chair with a variety of desirable and beneficial features. Because the strength of the back support force acting on a reclining occupant can be provided entirely by the resistance to pivotal motion of torso 14 relative to limbs 18, there is no requirement that a separate frame be disposed within bear 10 to provide back support. Because chair seat 40 can be removed from the stuffed figure chair to leave bear 10, the stuffed figure chair can also be utilized as an ordinary play toy rather than merely as a piece of furniture. The simple manner in which seat 40 is removably fastened to bear 10 allows seat 40 to be easily removed. Furthermore, the stuffed figure chair provides a seat 40 with connection means to bear 10 that require limited materials and manufacturing costs.

While this invention has been described as having a preferred design, the present invention can be further modified within the spirit and scope of this disclosure. For instance, the placement of the loops on bear 10 and the straps on seat 40 can be reversed, or the loops could be replaced with other straps which cooperate with or engage the seat straps. Instead of using straps 50, 51 to connect seat 40 to limbs 18, a single, longer strap could be used which would be threaded through both loops 30, 31 and then secured to seat 40 or even itself. Moreover, rather than attaching to loops fastening member 60, fabric straps 50, 51 could be secured to one another via tieing, hooks and loops press attachment, or in another fashion to provide the fastening of seat 40 to bear 10. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A chair, for use on a support surface, comprising:

a cushioned figure including a torso and first and second limbs, wherein the limbs are connected to said torso and extend forward from and generally perpendicular to said torso, the limbs each having an underside surface at least a portion of which contacts the support surface when the cushioned figure is positioned upright and is without a seat, the connections between said torso and limbs being sufficiently inflexible so as to provide a resistance to pivotal motion of the torso relative to the limbs and such that said limbs remain extended forward from said torso and such that the figure is self-supported when without a seat and positioned upright;

a removable seat structured to be received between the first and second limbs; and means for removably fastening the removable seat to the cushioned figure, said seat fastening means comprising first, second and third strap receiving members and first, second and third cooperating strap elements, wherein the first strap receiving member is attached to the underside surface of the first limb, the second strap receiving member is attached to the underside surface of the second limb, and the third strap receiving member is attached to the torso, the first, second and third cooperating strap elements are attached to the removable seat, the first and second strap receiving members being engagable with either the first or the second cooperating strap elements and the third strap receiving member being engagable with the third cooperating strap element to secure the removable seat to the cushioned figure limbs and torso, wherein the first and second cooperating strap elements attached to the removable seat each include opposing ends, wherein one end of each of the first and second cooperating strap elements is directly attached to the seat and proximate the other end of each of the first and second cooperating straps is a hooks fastening member, and wherein the seat fastening means further comprises at least one loops fastening member disposed on the seat and engagable with the hooks fastening member of the first and second cooperating strap elements, such that the first and second cooperating strap elements are received by the first and second strap receiving members, respectively, and the hooks fastening member of the first and second cooperating strap elements engage the at least one loops fastening member to secure the removable seat to the cushioned figure limb having the at least one strap receiving member attached thereto.

2. The chair of claim 1 wherein the cushioned figure is shaped in the form of an animal or human.

3. The chair of claim 1 further comprising a second pair of limbs connected to and extending from said torso and separate from said first pair of limbs such that the figure is shaped in the form of a four-limbed creature.

* * * * *